United States Patent [19]

Frost et al.

[11] Patent Number: 4,889,463

[45] Date of Patent: Dec. 26, 1989

[54] SLIP SHEET REMOVAL APPARATUS

[75] Inventors: Terry Frost, Rockford, Wash.; Terry B. Smith, Coeur D'Alene, Id.; Charles D. Vensel, Spokane, Wash.

[73] Assignee: ASC Machine Tools, Inc., Spokane, Wash.

[21] Appl. No.: 180,846

[22] Filed: Apr. 12, 1988

[51] Int. Cl.[4] ..... B65G 65/40

[52] U.S. Cl. ..... 414/416; 198/587; 198/631; 271/176; 271/280; 414/797.6; 414/929

[58] Field of Search ..... 414/403, 416, 129, 130, 414/797.4, 797.6, 797.7, 797.8, 929; 271/176, 280, 281; 198/412, 631, 468.01, 587

[56] References Cited

U.S. PATENT DOCUMENTS

| | | | |
|---|---|---|---|
| 3,184,030 | 5/1965 | Ludwig | 198/468.01 |
| 3,973,767 | 8/1976 | Kramer | 414/129 X |
| 4,046,370 | 9/1977 | Navi | 414/129 X |
| 4,093,064 | 6/1978 | Crane | 198/631 X |
| 4,349,186 | 9/1982 | Nakamura | 414/416 X |
| 4,518,301 | 5/1985 | Greenwell | 414/129 |
| 4,545,718 | 10/1985 | Marshall | 198/631 X |
| 4,732,375 | 3/1988 | Tetherton | 271/176 |

FOREIGN PATENT DOCUMENTS

| | | | |
|---|---|---|---|
| 2432776 | 2/1975 | Fed. Rep. of Germany | 414/129 |

*Primary Examiner*—David A. Bucci
*Attorney, Agent, or Firm*—Bill D. McCarthy

[57] ABSTRACT

A slip sheet removal apparatus for removing a dunnage sheet disposed beneath a paperboard blank stack conveyed by a conveyor assembly, the slip sheet removal apparatus comprising a dunnage sheet removal assembly having a stationary subassembly with roller driven drive belts and a retractable subassembly with guide belts thereon. Fluid actuators selectively raise and lower the retractable subassembly to engage a leading edge of the dunnage sheet as it advances on the conveyor assembly to pull the dunnage sheet underneath the conveyor assembly for storage and later removal. Also, a pivot conveyor assembly receives the paperboard stack from the conveyor assembly to alter the direction of travel thereof if required.

17 Claims, 6 Drawing Sheets

SLIP SHEET REMOVAL APPARATUS

BACKGROUND OF THE INVENTION

1. Field of the Invention

This invention relates generally to the field of material handling equipment, and more particularly but not by way of limitation, to a slip sheet removal apparatus incorporated in a conveyor system for removing dunnage sheets disposed under paperboard blank stacks.

2. Discussion

The packaging of products in paperboard containers or boxes has increased over the years so that a very large packing industry has emerged. It is common to cut paperboard container blanks from sheets of corrugated composition via rotating dies that operate at very great linear speeds. The blanks are removed of excess trim, stacked flat in bundles and conveyed on a conveyor system made up of a plurality of chain-driven conveyor rollers. To protect the paperboard blanks at the bottom of the stack it is common in the industry to place the paperboard blank stack on top of an individual dunnage sheet, sometimes also referred to as a slip sheet.

Heretofore there has been no conveyor system having the necessary apparatus to automatically remove the dunnage sheet at the end of a conveyor system so that the dunnage sheet can be stored and reused as necessary. Therefore, when the stack is removed from the conveyor the dunnage sheet is quite often soiled or damaged and therefore discarded. Because there has not been a device for automatically storing and recycling dunnage sheets, no care consideration has been given in using a higher grade of dunnage sheet material that can be used time and time again. Also, the bottom of the stack often serves as a dunnage sheet and a number of bottom paperboard blanks are damaged, thereby causing unnecessary waste.

The present slip sheet removal conveyor solves the above mentioned problems related to the use of dunnage sheet or the lack thereof with additional advantages which are described herein for ease in handling of paperboard blanks and the like.

Summary of the Invention

The present invention provides a slip sheet removal apparatus which is incorporated in a conveyor system for removing dunnage sheets disposed on top of conveyor rollers and under paperboard blank stacks. The slip sheet removal apparatus comprises a dunnage sheet removal assembly having a stationary subassembly with roller driven belts, and a retractable subassembly with roller supported guide belts. Actuators attached to the retractable subassembly raise and lower the subassembly. The retractable subassemblies engage a leading edge of the dunnage sheet as the dunnage sheet and the paperboard blank stack advance on conveyor rollers of a first roller conveyor. The stationary subassembly and retractable subassembly guide and pull the dunnage sheet underneath the conveyor rollers of the first roller conveyor for storage in a dunnage sheet drawer wherein the sheet can be removed for reusage. A photoelectric sensor device is disposed upstream from the dunnage sheet removal assembly for sensing when the paperboard blank stack passes thereby. The photoelectric sensor device signals the actuators to lower the retractable subassembly, and the paperboard blank stack is conveyed over the dunnage sheet removal assembly as its dunnage sheet is removed.

Also, a pivot roller conveyor disposed downstream from the dunnage sheet removal assembly receives the paperboard blank stack thereon. When the pivot roller conveyor receives the stack thereon the pivot roller conveyor is pivoted for indexing to a second roller conveyor so that the stack can be conveyed thereon.

The invention is characterized as incorporating a conveyor system with a dunnage sheet removal assembly which removes dunnage sheets from under stacks of paperboard blanks without interrupting the conveying of the paperboard blank stacks on top of the conveyor.

The slip sheet removal conveyor allows for the removal of dunnage sheets, and provides storage for a plurality of dunnage sheets beneath the conveyor so that the dunnage sheets are collected for reuse in protecting the bottoms of paperboard blank stacks.

The present invention saves time and labor by eliminating the manual handling of individual dunnage sheets when tee stacks are removed from the conveyor. Further, a better grade of dunnage sheet can be used since it can be recycled rather than, as in the past, thrown away after initial use. Also, with the present invention, the use of dunnage sheets is facilitated to protect the lower paperboard blanks from damage.

Objects, features and advantages of the present invention will become clear from the following description of the preferred embodiment when read in conjunction with the accompanying drawings and appended claims.

DESCRIPTION

In the following description the slip sheet removal apparatus of the present invention, like numerals and characters will designate like elements throughout the figures of the drawings.

Figure 1:
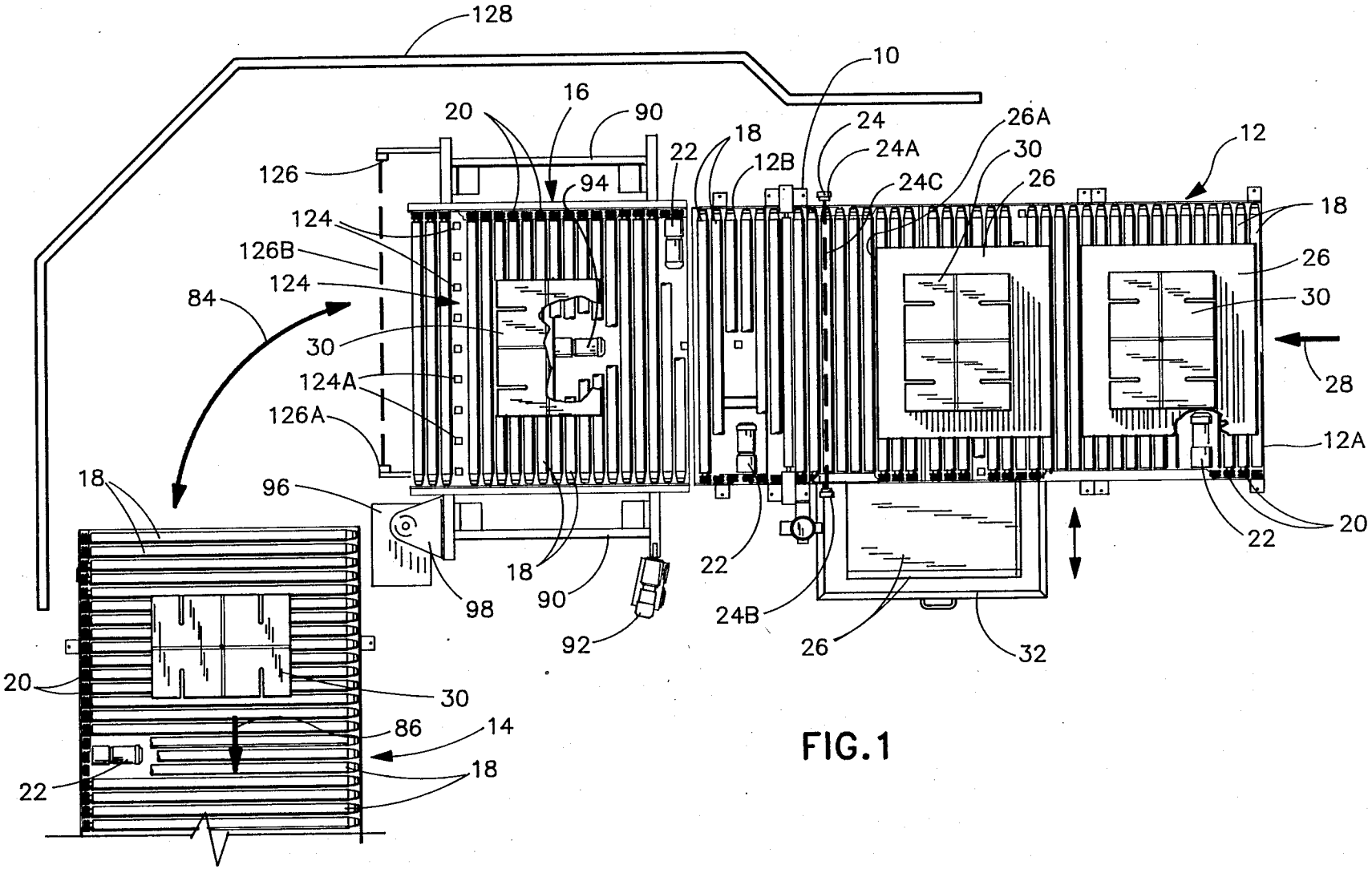
FIG. 1 is a top plan view of a slip sheet removal apparatus constructed in accordance with the present invention.

Referring generally to the drawings and more particularly to FIG. 1, shown therein are the following.

10 depicts a slip sheet removal apparatus constructed in accordance with the present invention.

12 is a first roller conveyor assembly (also sometimes referred to herein as the first conveyor assembly) having an upstream conveyor section 12A and a downstream conveyor section 12B.

14 is a second roller conveyor assembly (also sometimes referred to herein as the second conveyor assembly) disposed downstream to the first conveyor assembly 12.

16 is an intermediate conveyor assembly which is also referred to herein as a pivot conveyor assembly.

18 depicts parallel, powered conveyor rollers which provide the rolling conveying elements in each of the first, second and pivot conveyors 12, 14 and 16, respectively.

20 depicts a sprocket gear mounted at one end of each of the conveyor rollers 18. These sprocket gears 20 are engaged by motor driven, sprocket to sprocket chains for rotating the conveyor rollers 18. These endless chains are not shown in the drawings so that the clarity of the view of the structure is improved. Also, throughout the drawings certain portions of the conveyor rollers 18 have been removed to show structure disposed underneath the conveyor assemblies 12, 14 and 16.

22 are electric motor/gear box units for driving the endless chains (not shown) on the conveyor assemblies 12, 14 and 16.

24 is a photoelectric sensor device, with a light beam transmitter 24A and reflector 24B, disposed just upstream to other portions of the slip sheet removal apparatus 10. A light beam 24C, shown in a dashed line, is transmitted across the downstream end of the upstream conveyor section 12A and parallel to the conveyor rollers 18 thereof.

26 depicts dunnage sheets, and the leading edge of each is designated 26A.

28 depicts the direction of travel imparted to items transported on the powered first conveyor assembly 12.

30 depicts paperboard blank stacks which are being transported in direction 28 via the first conveyor assembly 12. Each of the paperboard blank stacks 30 has one of the dunnage sheets 26 thereunder. Heretofore, when paperboard blank stacks were transported by conveyor assemblies, the bottoms of such stacks were soiled or damaged, resulting in wasted materials. The dunnage sheets 26 protect the bottom of the paperboard blank stacks 30 as such are transported on the first conveyor assembly 12. The slip sheet removal apparatus 10 is designed to remove the dunnage sheets 26 from beneath the paperboard blank stacks 30 without interrupting the conveying of the paperboard blank stacks 30. While the paperboard blank stacks 30 are shown in the drawings it will be appreciated that the slip sheet removal apparatus 10 of the present invention can be used equally well for different types of goods and products moved on conveyor systems and which are protected by dunnage sheets and the like. Also, it should be noted that the spacings depicted for the two paperboard blank stacks 30 in FIG. 1 on the upstream conveyor section 12A is for illustrative purposes only, and such spacing will be controlled by selections made upstream to the upstream conveyor section 12A. For purposes of the present discussion the forward most paperboard blank stack 30 on the upstream conveyor section 12A will be discussed.

32 is a dunnage sheet drawer which is slidably supported under the upstream conveyor section 12A to receive dunnage sheets 26 that are removed from beneath the paperboard blank stacks 30. The dunnage sheet drawer 32 is shown partially removed from beneath the upstream conveyor section 12A and as having a couple of dunnage sheets 26 from the paperboard blank stacks 30 depicted in FIG. 1 as having passed downstream from the slip sheet removal apparatus 10. In operation, the dunnage sheet drawer 32 will be pushed beneath the upstream conveyor section 12A and removed only for emptying purposes.

Figure 2:
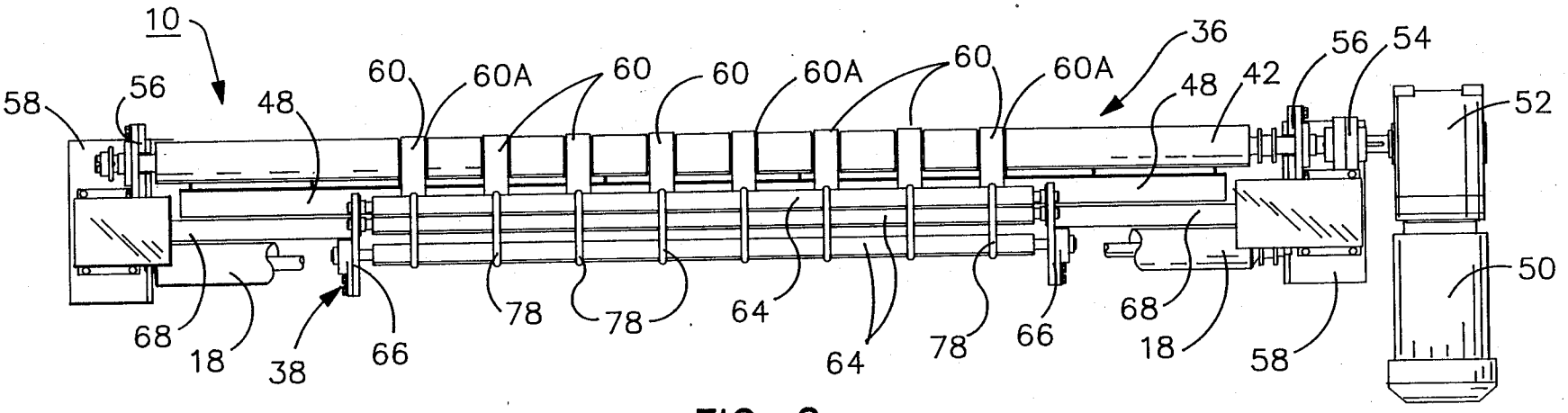
FIG. 2 is a partial top view of a dunnage sheet removal assembly of the slip sheet removal apparatus of FIG. 1.
Figure 3:
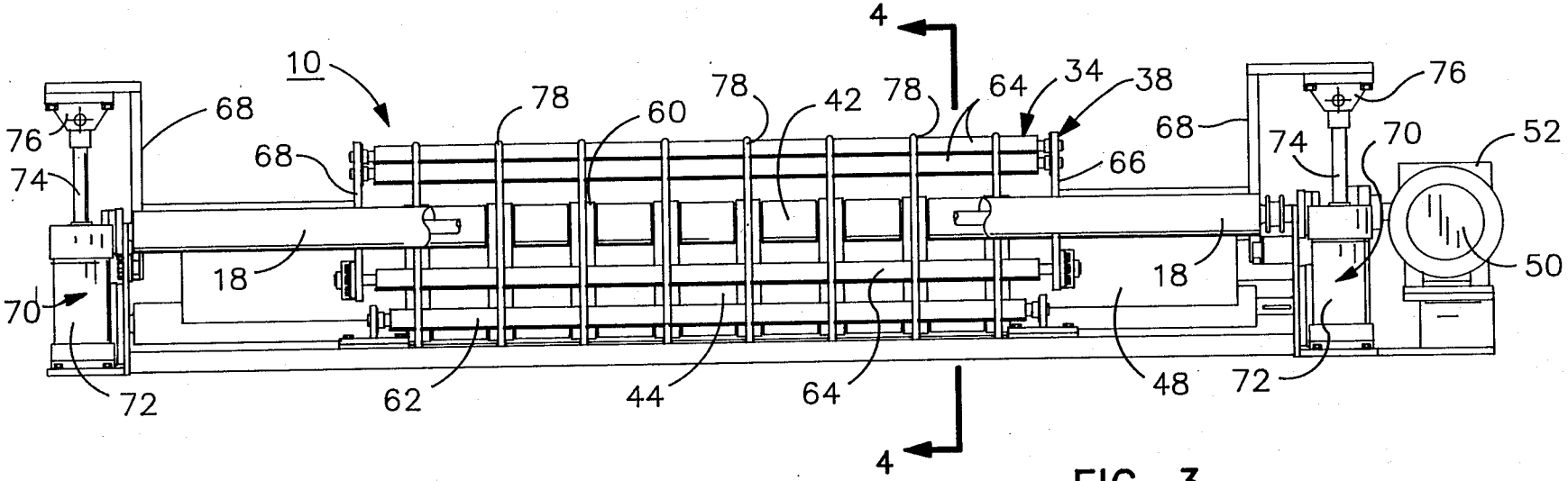
FIG. 3 is an elevational view of the dunnage sheet removal assembly looking upstream toward a first roller conveyor of the slip sheet removal apparatus of FIG. 1.

Reference is now directed to FIG. 2 which shows a top plan view of the slip sheet removal apparatus 10, and to FIG. 3 which is an elevational view of same. The slip sheet removal apparatus 10 is comprised of the following.

Figure 4:
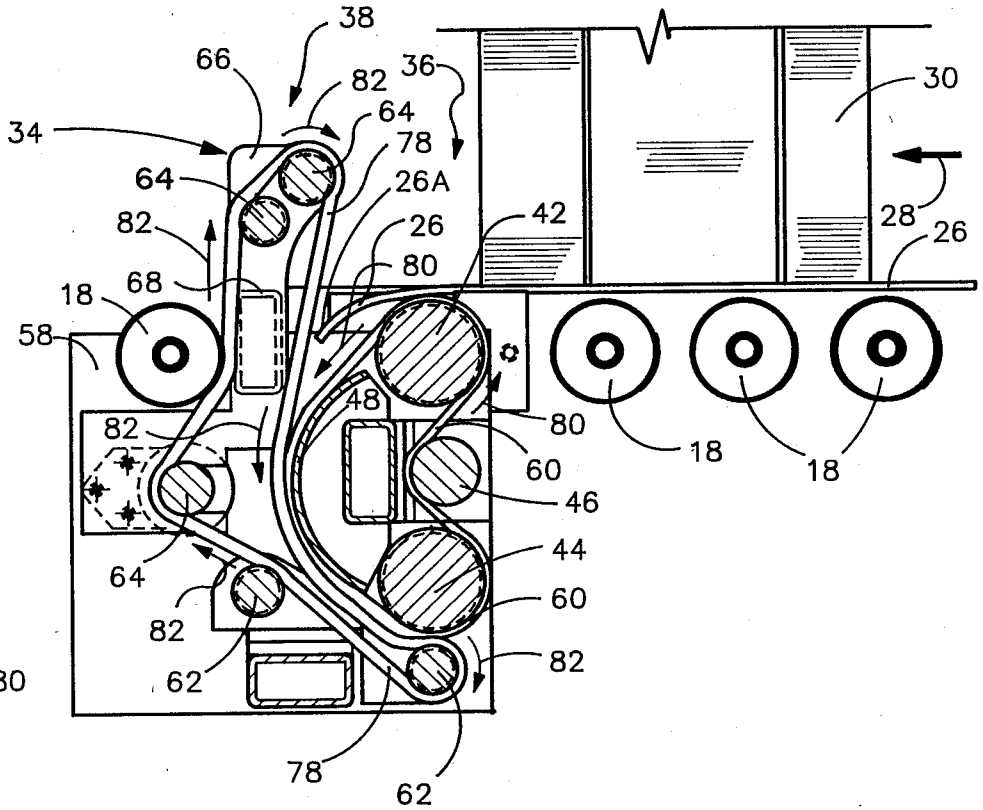
FIG. 4 is a sectional view of the dunnage sheet removal assembly taken along 4—4 in FIG. 3.
Figure 4A:
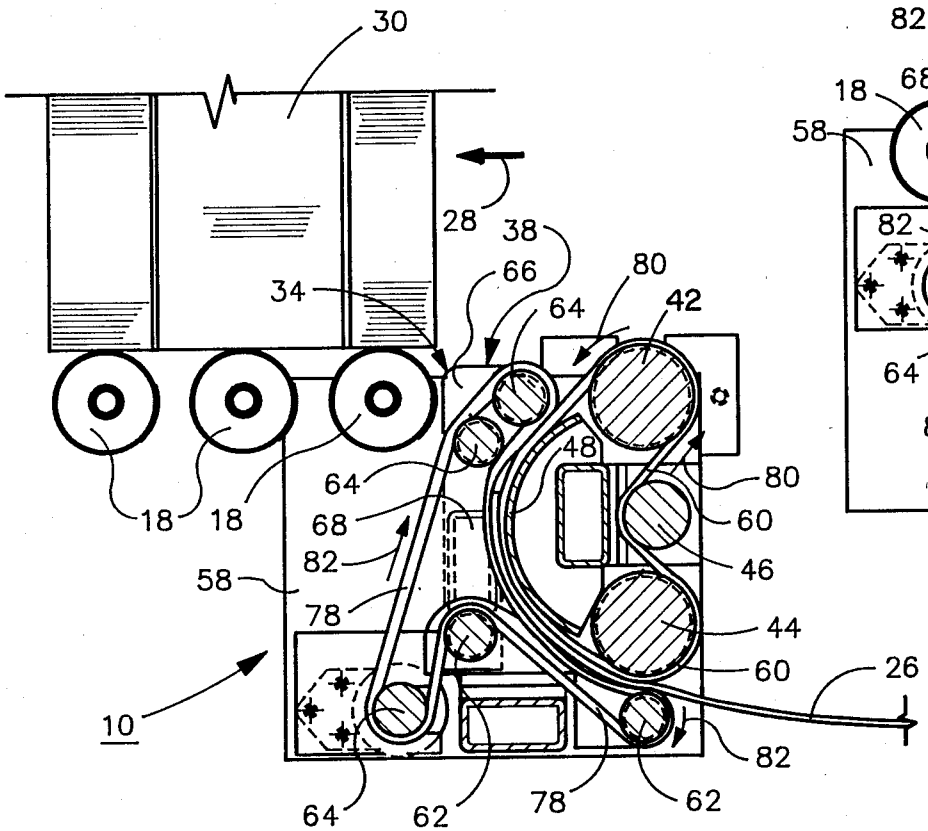
FIG. 4A is similar to FIG. 4 but illustrates a retractable subassembly portion in its lowered position.

34 is a dunnage sheet removal assembly shown in FIG. 3 and in cross section in FIGS. 4 and 4A.

36 is a stationary subassembly portion of the dunnage sheet removal assembly 34.

38 is a retractable subassembly portion of the dunnage sheet removal assembly 34.

70 is an actuator assembly which serves to selectively extend and lower the retractable subassembly 38 to extend an upper portion thereof above the top of the conveyor rollers 18 of the first roller conveyor assembly 12 for the purpose described hereinbelow.

The stationary subassembly 36 portion of the dunnage sheet removal assembly 34 includes the following components:

42 is a drive roller;

44 is an idler roller, shown in cross section in FIGS. 4 and 4A;

46 is a tension roller, shown in cross section in FIGS. 4 and 4A;

48 is a convex belt guide;

50 is a stationary drive motor;

52 is a gear reduction box;

54 is a coupling;

56 is a bearing housing; and 58 is a subassembly support frame.

The rollers 42, 44 and 46, together with the belt guide 48, extend across the width of the dunnage sheet removal assembly 34 parallel to the conveyor rollers 18 and are supported by the stationary subassembly support frame 58. The drive motor 50 is connected to one end of the drive roller 42 via the gear reduction box 52, the coupling 54 and the bearing housing 56. The opposite end of the drive roller 42 is mounted in another bearing housing 56. The bearing housings 56 are secured to the subassembly support frame 58.

60 depicts a plurality of drive belts which are received in notches 60A along the drive roller 42. The drive belts 60 are wound around the drive roller 42, idler roller 44, tension roller 46 and a portion of the belt guide 48 as shown in FIGS. 4 and 4A.

Turning now to the retractable subassembly 38 of the dunnage sheet removal assembly 34, it will be noted that the retractable subassembly 38 includes the following:

62 depicts a pair of idler rollers rotatably supported at opposite ends by the subassembly support frame 58;

64 depicts three movable, or rotatable idler rollers;

66 depicts a pair of spaced apart idler roller mounting brackets, and each of the idler rollers 64 is supported at opposite ends by a pair of idler roller mounting brackets 66; and 68 depicts a pair of retraction arm members, each of which extends from one of the idler roller mounting brackets 66.

70 denotes a pair of fluid actuators disposed on opposite sides of the retractable subassembly 38. As used herein, the term "fluid" is used in its general sense and fluid actuators shall mean hydraulic or pneumatic devices, the latter being preferred for this application. Each of the fluid actuators 70 is supported by the subassembly support frame 58 and is attached to one of the retraction arm members 68 as shown. Each fluid actuator 70 includes, in addition to a fluidic power circuit that is conventional and need not be described herein, as follows:

72 is a cylinder assembly.

74 is a piston ram which is extendible from or retractable into the cylinder assembly 72 via conventional fluidic pressure control; and 76 is a piston connecting bracket.

The upper end of each piston ram 74 is secured to one of the retraction arm members 68. When activated by fluid pressure, the fluid actuators 70 cooperate to lift the retraction arm members 68, thereby lifting the retractable subassembly 38 portion of the dunnage sheet removal assembly 34 to its extended position as shown in FIGS. 3 and 4. When fluidic pressure is removed from the fluid actuators 70, the piston rams 74 retract within the cylinder assemblies 72 to lower the retractable subassembly 38 to its retracted position shown in FIG. 4A.

As mentioned above, the photoelectric sensor 24 is disposed to transmit a light beam across the downstream end of the upstream conveyor section 12A just upstream to the dunnage sheet removal assembly 34. The use of such sensors is conventional so it is sufficient to simply state that the fluidic power circuit connected to the fluid actuators 70 is made responsive to the output signal of the photoelectric sensor 24. When a paperboard stack passes by the photoelectric sensor 24 to break the light beam 24C, the fluid actuators 70 are caused to move the retractable subassembly 38 downwardly. If the light beam is unbroken, the fluid actuators 70 extends the retractable subassembly 38 upwardly.

Returning to the retractable subassembly 38 it will be noted that the drawings provided in FIGS. 2, 3, 4 and 4A contain the following numerical designations:

78 depicts a plurality of guide belts;

80 depicts arrows which indicate a counter clockwise direction of movement; and 82 depicts arrows which indicate a clockwise direction of movement.

The guide belts 78 are received around the stationary idler rollers 62 and the movable idler rollers 64 as shown in FIGS. 4 and 4A. The guide belts 78 are disposed in spaced apart relationship to each other along the length of the rollers 62, 64, and each is centered on one of the drive belts 60 of the stationary subassembly 36. In operation, the drive belts 60, driven by the drive roller 42 in the counter clockwise direction 80, rotate the guide belts 78 downwardly in the clockwise direction 82. The moving guide belts 78 in turn rotate rollers 62 and 64 in the clockwise direction 82, except for the single roller 62 disposed outside the loops of guide belts 78.

In operation, the actuators 70 are normally pressure extended to maintain the retractable subassembly 38 in the "up" position so that the upper portion thereof extends above the level of the top of the conveyor rollers of the first conveyor assembly 12. As the first conveyor assembly 12 transports one of the dunnage sheets 26 bearing paperboard blank stack 30 toward the dunnage sheet removal assembly 34, the leading edge 26A of the dunnage sheet 26 is moved against the clockwise rotating guide belts 78. The dunnage sheet 26 is flexible, and this permits the leading edge 26A to be pulled downwardly as shown in FIG. 4.

When the paperboard blank stack 30 interrupts the light beam 24A of the photoelectric sensor 24, the fluidic power circuit is signalled to retract the actuators 70, thereby lowering the retractable subassembly 38 to the position shown in FIG. 4A. It will be noted that the top of the upper movable idler roller 64 is just below the level of the top of the adjacent conveyor rollers 18 so that, when the retractable subassembly 38 is in the "down" position, the paperboard blank stack 30 continues to be conveyed by the first conveyor assembly 12 downstream past the dunnage sheet removal assembly 34.

As the retractable subassembly 38 is lowered, the leading edge 26A of the dunnage sheet 26 is pinched between the guide belts 78 and the drive belts 60. The guide belts 78 and the drive belts 60 cooperate to pull the dunnage sheet 26 downwardly, reversing its direction of travel and guiding it to be disposed beneath the first conveyor assembly 12 where it is received in the dunnage sheet drawer 32.

Once the paperboard blank stack 30 has passed the photoelectric sensor device 24, the light beam 24A is reestablished so that the fluidic power circuit repressures the fluid actuators 70 to again raise the retractable subassembly 38 to the up position to confront and remove the next dunnage sheet 26.

Mention should now be made with regard to the preferable timing of the sequence of operation above described. In practice, the travel speed of the guide belts 78 and the drive belts 60 is desirably established such that the dunnage sheet 26 being removed is caused to travel at the same velocity as that imparted by the powered conveyor rollers 18 of the first conveyor assembly 12. Also, it is desirable to utilize certain timing circuits to temporarily halt the travel of the paperboard blank stack 30 at the position that it first interrupts the light beam 24A and as the retractable subassembly 38 is lowered to pinch capture the leading edge 26A of the dunnage sheet 26. Further, it is desirable to incorporate a delay in raising the retractable subassembly 38 after the light beam 24A is reestablished once the paperboard blank stack 30 has passed the position of the photoelectric cell 24. This permits sufficient time for the paperboard blank stack 30 to pass over the slip sheet removal apparatus 10 and for the removed dunnage sheet 26 to be deposited in the dunnage sheet drawer 32.

Returning to FIG. 1, further description will now be provided to the intermediate or pivot conveyor assembly 16 which is disposed to receive the paperboard blank stacks 30, without dunnage sheets 26, from the first conveyor assembly 12. Of course, where applicable, the upstream end of the second conveyor assembly can be disposed against the downstream conveyor section 12B of the first conveyor assembly 12, in which case there would be no need for an intermediate conveyor section. The pivot conveyor assembly 16 is useful where the requirement exist to change the direction of flow of the paperboard blank stacks 30 once such have had the dunnage sheets thereof removed.

The pivot conveyor assembly 16 is disposed next to the downstream conveyor section 12B in the position shown in FIG. 1, and as will become clear, is capable of being pivoted through a desired angle. In FIG. 1:

84 depicts an angle of rotation; and 86 is the direction of travel imparted by the second roller conveyor assembly 14.

When rotated through the angle 84 (shown as 90 degrees in FIG. 1), the downstream end of the pivot conveyor assembly 16 is brought into near contact with the upstream end of the second conveyor assembly 14 to transfer paperboard blank stack 30 thereto for conveyance in the direction 86.

Figure 5:
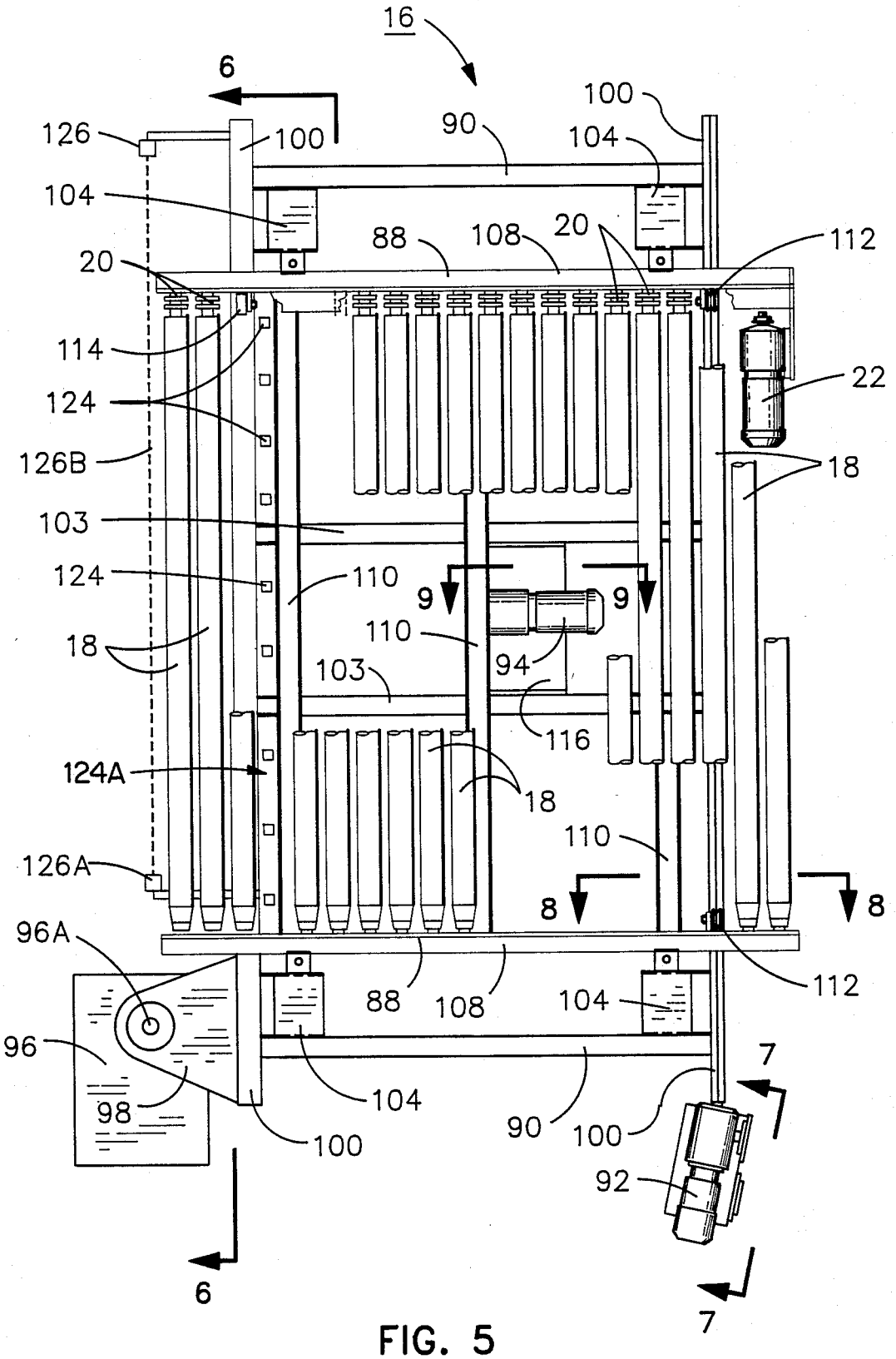
FIG. 5 is a top plan view of a pivot roller conveyor portion of the slip sheet removal apparatus of FIG. 1.
Figure 6:
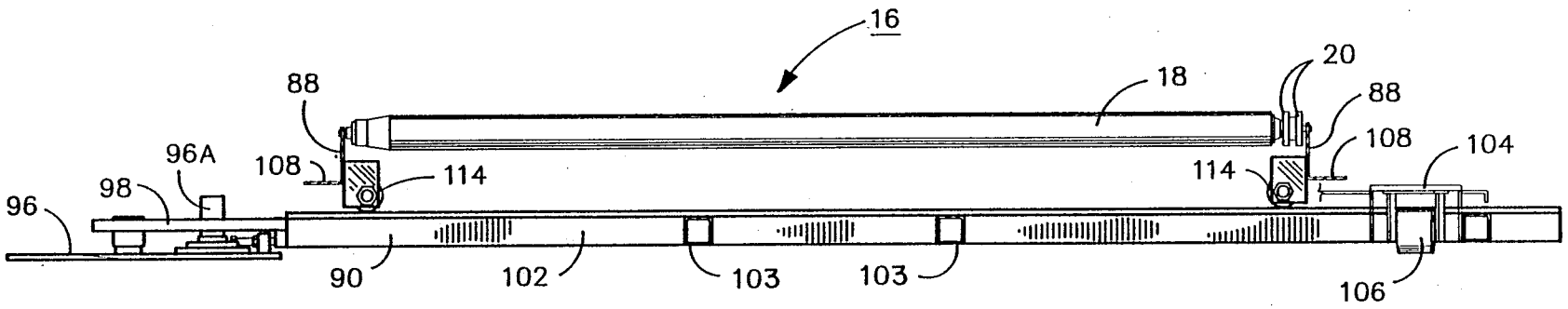
FIG. 6 is a view taken along 6—6 in FIG. 5.
Figure 8:
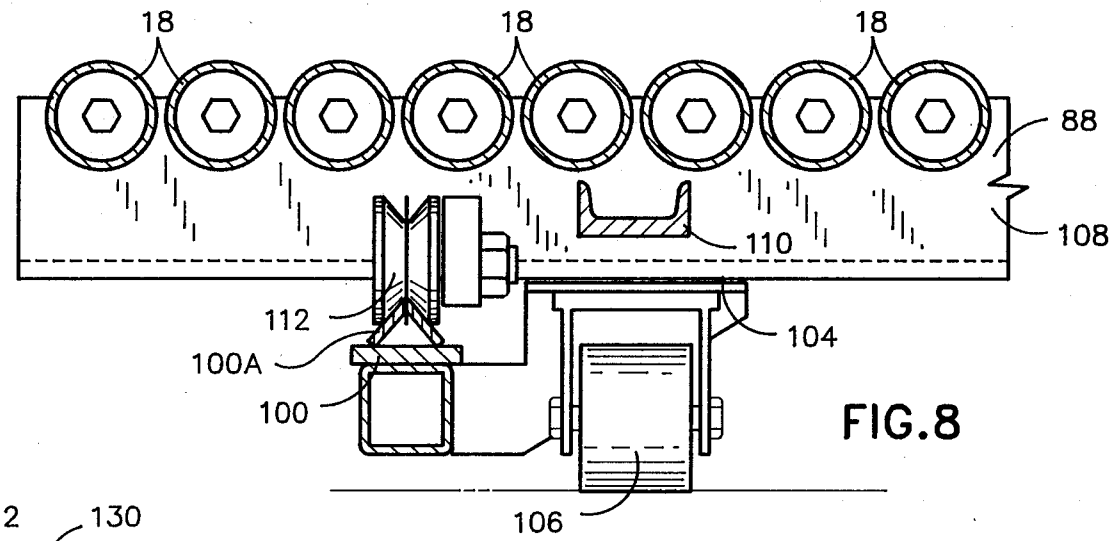
FIGS. 8 and 9 are views taken along 8—8 and 9—9, respectively, in FIG. 5.

As shown in FIG. 1 and the enlarged view of FIG. 5, the conveyor assembly 16 includes the following:

88 is a roller frame which supports the conveyor rollers 18 of the conveyor assembly 16.

90 is a lateral frame disposed underneath the roller frame 88.

92 is a wheel mounted electric motor attached to one side of the lateral frame 90. The electric power cord (not shown) to the electric motor 92, which is a reversible drive motor, can be provided a conventional spring controlled loop or take up coil to permit travel of the electric motor 92.

94 is a lateral frame electric motor supported by the lateral frame 90. As will become clear below, the electric motor 94, which is a reversible drive motor, serves to move the roller frame 88 laterally so that the paperboard blank stack 30 is centered with respect to the second conveyor assembly 14 before the paperboard blank stack 30 is transferred thereto.

96 is a pivot plate supported by, and secured to, the floor surface on which the conveyor assembly 16 is supported. 96A is a pivot pin supported to extend upwardly from the pivot plate 96.

98 is a pivot pin mounting bracket having a bearing which is received about the pivot pin 96A. The pivot pin mounting bracket 98 is attached to the lateral frame 90 on the same side as the wheel mounted electric motor 92 so that the lateral frame 90 is pivotable thereby about the pivot pin 96A.

FIGS. 5 through 8 provide further details of the structural construction of the pivot conveyor assembly 16 and the components thereof.

100 depicts a pair of elongated side frame members one of which has an inverted V-shaped track 100A therealong.

102 depicts a pair of end frame members.

103 is a pair of cross support members.

104 depicts four pivot wheel mounting plates.

106 depicts four pivot wheels.

The side frame members 100, the cross support members 103, and the end frame members 102 are joined together to form the lateral frame 90. One of the pivot wheel mounting plates is attached at each corner of the lateral frame 90 as shown. One each of the pivot wheels 106 is bearingly attached to the underside of each of the pivot wheel mounting plates 104. The pivot wheels 106 serve to support the pivot roller conveyor assembly 16 as it is moved by the wheel mounted electric motor 92.

108 depicts a pair of roller side frame members.

110 depicts three roller cross support members

112 is a pair of grooved rollers.

114 is a pair of rollers.

The roller side frame members 108 are joined with the three roller cross support members 110 to form the roller frame 88 which in turn supports the conveyor rollers 18 as shown. The pair of grooved rollers 112 are attached to the underside of one of the roller side frame members 108 and engage the inverted V-shaped 100A on one of the side frame members 100 of the lateral frame 90 as the roller frame 88 moves relative to the lateral frame 90. The other rollers 114 (one of which is viewable in FIG. 5) are attached to the other roller side frame member 108 and engages the flat top of the other side frame member 100.

Figure 9:
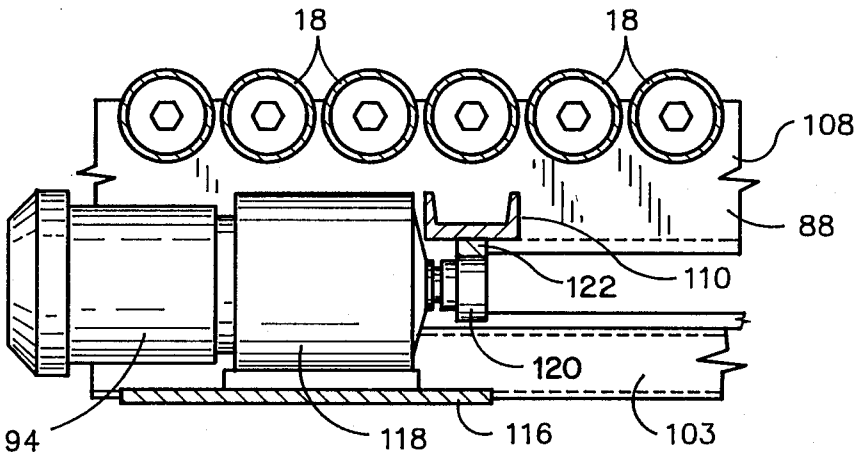
Figure 7:
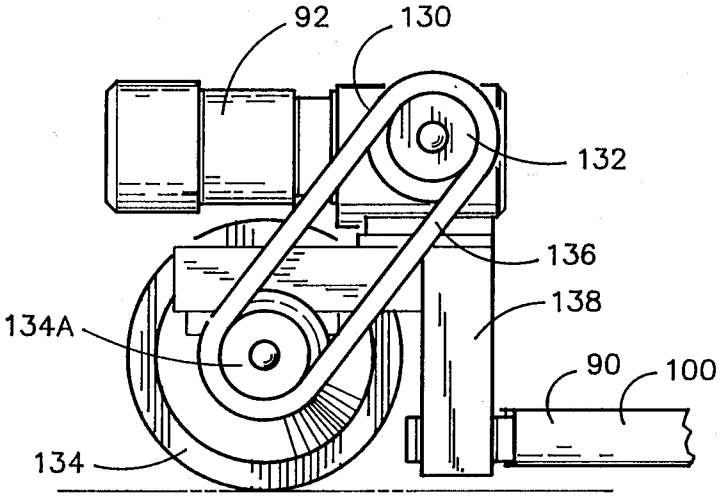
FIG. 7 is a view taken along 7—7 in FIG. 5.

116 is a motor mounting plate attached to the two cross support members 103 of the lateral frame 90 to support the lateral frame electric motor 94 thereon as shown in FIGS. 5 and 9.

118 is a gear box drivingly connected to the lateral frame electric motor 94.

120 is a drive gear driven by the output shaft of the gear box 118.

122 is a rack gear supported on the underside of one of the roller cross support members 110, and the drive gear 120 is gearingly engaged with the rack gear 122.

When the lateral frame electric motor 94 is energized the drive gear 120 moves the rack gear 122 and thus the roller frame 88 to one side or the other, depending on the selected rotation direction of the electric motor 94. The purpose of this arrangement is to achieve centering of the paperboard blank stack 30 relative to the second roller conveyor 14 as the paperboard blank stack 30 is conveyed thereto: To this end, the conveyor assembly 16 is provided with the following sensory devices:

124 depicts several photoelectric cells located beneath the conveyor rollers 18 of the pivot conveyor assembly 16 on the lateral frame 90 and disposed to sense upwardly through a small gap 124A conveniently left between a pair of the conveyor rollers 18 near the downstream end of the pivot conveyor assembly 16. The photoelectric cells 124 are depicted schematically in FIGS. 1 and 5 in which the gap 124A is shown in exaggeration. The photoelectric cells 124 are conventionally available devices which sense an object reflecting the beams within a short focal length thereof. It is not believed necessary to describe the electrical circuit which electrically interconnects the photoelectric cell 124 and lateral frame electric motor 94 except to note that these cooperate to center the paperboard blank stack 30 by the photoelectric cells 124 seeking to move the stack to cover the least number of such cells. This is achieved by signalling the lateral frame electric motor 94 to move the roller frame 88 via the interaction of the drive gear 120 and rack gear 122.

126 is another photoelectric sensor device and a reflector 126A which together establish a light beam 126B.

128 is a safety guard to maintain a cleared area around a portion of the pivot conveyor assembly 16.

130 is a gear box connected to the wheel mounted electric motor 92.

132 is a chain sprocket driven by the gear box 130.

134 is a pivot roller conveyor wheel which supports the wheel mounted electric motor 92, and 134A is a drive sprocket attached to the pivot roller conveyor wheel 134.

136 is an endless chain drivingly connecting the chain sprocket 132 and the drive sprocket 134A.

138 is a frame structure supported by the pivot roller conveyor wheel 134 to in turn support the wheel mounted electric motor 92. The frame structure 138 is attached to the elongated side frame member 100 (the one with the V-shaped track 100A) of the lateral frame 90.

The wheel mounted electric motor 92, when energized, serves to pivot the pivot conveyor assembly 16 along the path indicated by the angle 84 so that, in addition to the position shown in FIG. 1, the pivot conveyor assembly 16 can be rotated such that its downstream end is adjacent to the upstream end of the second conveyor assembly 14. In this movement of the pivot conveyor assembly 16, the photoelectric sensor 126 will signal the wheel mounted electric motor 92 to stop if the photoelectric sensor 126 is broken by any foreign object. Of course, the purpose of the safety guard 128 is to limit access to the turning area. Also, other photoelectric sensors (not shown) can be placed at other locations as further safety precautions.

It will be appreciated that numerous construction details of the above described slip sheet removal apparatus and of the conveyor assemblies 12, 14 and 16, respectively, have been omitted as such details are not considered necessary to include herein for the reason that such will be known by one of ordinary skill who wishes to make and operate the invention provided herein.

It will be noted that the slip sheet removal apparatus 10 is incorporated in the conveyor system comprised of the first, second and pivot conveyor assemblies 12, 14 and 16, respectively, and that the slip sheet removal apparatus 10 is disposed to remove the dunnage sheets 26 from the paperboard blank stacks 30 as same are conveyed along the first conveyor assembly 12. As a paperboard blank stack 30 approaches the dunnage sheet removal assembly 34 it interrupts the light beam 24A which preferably momentarily signals for stoppage of the first roller conveyor assembly 12. At this point the leading edge 26A of the dunnage sheet 26 has come into engagement with the raised retractable subassembly 38 which has been maintained in the raised position by the fluid actuators 70. The interruption of the light beam 24A by the paperboard blank stack 30 signals for the retraction of the retractable subassembly 38, which causes the leading edge 26A, being flexible, to be pinched or captured by the cooperative interaction of the guide belts 78 and the drive belts 60 for forced movement of the dunnage sheet 26 in a direction that sends it beneath the first conveyor assembly 12. Preferably, the rotation speeds of the conveyor rollers 18 of the first conveyor assembly 12 and that of the belts 60, 78 are coordinated such that the dunnage sheet 26 is pulled from beneath the above passing paperboard blank stack 30 without imparting any forces to the moving paperboard blank stack 30 that might cause it to fall over.

Once the paperboard blank stack 30 has passed over the dunnage sheet removal assembly 34, the retractable subassembly 38 is again raised to await another dunnage sheet arrival. The paperboard blank stack 30 without its dunnage sheet is moved onto the pivot conveyor assembly 16, which centers the paperboard blank stack by the mechanism described hereinabove and is pivoted through the angle 84 via the powering of the wheel mounted electric motor 92 and the supporting pivot wheels 106 to a position that places the downstream end of the pivot conveyor assembly next to the upstream end of the second conveyor assembly 14, and the paperboard blank stack 30 is conveyed thereupon. Once the paperboard blank stack 30 has been removed from the pivot conveyor assembly 16, its photoelectric sensor devices 124 sense that there is no object disposed over same, and this signals, via an appropriate circuit, the wheel mounted electric motor 92 to reverse the travel direction of the pivot roller conveyor wheel 134.

It is clear that the present invention is well adapted to carry out the objects and to attain the ends and advantages mentioned herein as well as those inherent in the invention. While the presently preferred embodiment of the invention has been described for purposes of this disclosure, numerous changes can be made which will readily suggest themselves to those skilled in the art and which are accomplished within the spirit of the invention disclosed and as defined by the appended claims.

What is claimed is:

1. A slip sheet removal apparatus for removal of a dunnage sheet from beneath a paperboard blank stack conveyed on a conveyor assembly, the slip sheet removal apparatus comprising:

dunnage sheet removal means for engaging a leading edge of the dunnage sheet and for moving the dunnage sheet to beneath the conveyor assembly as the paperboard blank stack is conveyed along the conveyor assembly, a portion of the dunnage sheet removal means having an up position and a down position, in the up position the portion of the dunnage sheet removal means extending above the top of the conveyor assembly so as to engage the leading edge of the dunnage sheet, in the down position the portion of the dunnage sheet removal means being retracted so as to permit the paperboard blank stack to be conveyed along the conveyor assembly past the dunnage sheet removal means;

actuator means for selectively raising and lowering the portion of the dunnage sheet removal means between the up and down position; and sensing means for sensing the arrival of the paperboard blank stack at a predetermined position upstream to the dunnage sheet removal means and signalling the actuator means to selectively move the portion of the dunnage sheet removal means between the up and down position.

2. A slip sheet removal apparatus for removal of a dunnage sheet from beneath a paperboard blank stack conveyed on a conveyor assembly, the slip sheet removal apparatus comprising:

dunnage sheet removal means for engaging the dunnage sheet and for moving the dunnage sheet to beneath the conveyor assembly as the paperboard blank stack is conveyed along the conveyor assembly, the dunnage sheet removal means comprising:

a stationary subassembly having roller driven drive belts; and a retractable subassembly having idler roller supported guide belts, the drive belts and guide belts disposable to move the removed dunnage sheet from beneath the paperboard blank stack, the retractable subassembly selectively movable between an up position and a down position, the leading edge of the dunnage sheet being engaged by the retractable subassembly in its up position, the retractable subassembly in its down position cooperating with the stationary subassembly to move the dunnage sheet to beneath the conveyor assembly;

actuator means connected to the retractable subassembly for selectively moving the retractable subassembly between the up position and the down position, in the up position the retractable subassembly extending above the top of the conveyor assembly so that the dunnage sheet to be removed is engaged and removed from beneath the paperboard blank stack; and sensing means for sensing the arrival of the paperboard blank stack at a predetermined position upstream to the retractable subassembly and signalling the actuator means to selectively raise and lower the dunnage sheet removal portion.

3. The slip sheet removal apparatus of claim 2 further comprising:

dunnage sheet drawer means disposed under the conveyor assembly for receiving and storing the removed dunnage sheet.

4. The slip sheet removal apparatus of claim 3 wherein the sensing means comprises:

a photoelectric sensor device which in an energized mode thereof establishes a light beam across the top of the conveyor assembly so that the paperboard blank stack is sensed by the photoelectric sensor device when the dunnage sheet has come into contact with the raised retractable subassembly.

5. The slip sheet removal apparatus of claim 4 further comprising:

a pivot conveyor means disposed downstream to the conveyor assembly for receiving the paperboard blank stack following dunnage sheet removal therefrom and for conveying the paperboard blank stack along a path at an angle to the path of travel imparted to the stack by the conveyor assembly.

6. The slip sheet removal apparatus of claim 5 wherein the pivot conveyor means comprises:

a roller frame supporting a plurality of power rotatable conveyor rollers;

means for powering the conveyor rollers;

a lateral frame supporting the roller frame for movement in a lateral direction;

means supported by the lateral frame for selectively moving the roller frame to a selected lateral position on the lateral frame in response to the position of the stack disposed on the conveyor rollers; and means for supporting and selectively rotating the lateral frame to the selected angle.

7. The slip sheet removal apparatus of claim 6 wherein the means for supporting and rotating the lateral frame comprises:

pivot means attached to one side of the lateral frame for pivoting same about a fixed point; and power means for selectively rotating the lateral frame relative to the pivot means.

8. The slip sheet removal apparatus of claim 7 wherein the pivot means comprises:

a stationary pivot plate supporting a vertically extending pivot pin; and a pivot pin mounting bracket secured to the lateral frame and rotatably connected to the pivot pin.

9. The slip sheet removal apparatus of claim 8 wherein the power means further comprises:

a frame structure;

a pivot roller conveyor wheel bearingly supporting the frame structure, the frame structure connected to the lateral frame so that the lateral frame is propelled upon rotation of the pivot roller conveyor wheel; and reversible motor means supported by the frame structure for selectively driving the pivot roller conveyor wheel.

10. A slip sheet removal apparatus for removing a dunnage sheet from beneath a paperboard blank stack being conveyed on a conveyor assembly, the slip sheet removal apparatus comprising:

a dunnage sheet removal assembly comprising:

a stationary subassembly having at least one drive belt;

a retractable subassembly movably supported by the stationary subassembly and having at least one roller supported guide belt, a portion of the retractable subassembly selectively extendible above the top of the conveyor assembly, the drive belt and guide belt of the stationary subassembly and the retractable subassembly disposed to cooperatively engage a leading edge of the dunnage sheet as the dunnage sheet advances on the conveyor assembly to pull the dunnage sheet underneath the conveyor assembly; and means for selectively powering the drive belt of the stationary subassembly;

actuator means attached to the retractable subassembly for selectively extending and lowering the retractable subassembly to extend a portion of the retractable subassembly above the top of the conveyor assembly to engage the leading edge of the dunnage sheet; and sensing means for sensing the position of the paperboard blank stack and the signalling the actuator means to selectively extend the retractable subassembly to an up position to engage the dunnage sheet leading edge and to selectively retract the retractable subassembly to a down position.

11. The slip sheet removal apparatus of claim 10 wherein the sensing means comprises a photoelectric sensor device establishing a light beam across the top of the conveyor assembly so that the paperboard blank stack is sensed by the photoelectric sensor device when the leading edge of the dunnage sheet has come into contact with the retractable subassembly in the up position thereof.

12. The slip sheet removal apparatus of claim 11 further comprising:

pivot conveyor means disposed downstream to the conveyor assembly for receiving the paperboard blank stack following dunnage sheet removal therefrom and for conveying the paperboard blank stack along a path at an angle to the path of travel imparted to the stack by the conveyor assembly.

13. The slip sheet removal apparatus of claim 12 wherein the pivot conveyor means comprises:

a roller frame supporting a plurality of power rotatable conveyor rollers;

means for powering the conveyor rollers; a lateral frame supporting the roller frame for movement in a lateral direction;

means supported by the lateral frame for selectively moving the roller frame to a selected lateral position on the lateral frame in response to the position of the stack disposed on the conveyor rollers; and means for supporting and selectively rotating the lateral frame to the selected angle.

14. The slip sheet removal apparatus of claim 13 further comprising:

drawer means for collecting and retaining the removed dunnage sheet.

15. The slip sheet removal apparatus of claim 13 wherein the means for supporting and rotating the lateral frame comprises:

pivot means attached to one side of the lateral frame for pivoting same about a fixed point; and power means for selectively rotating the lateral frame relative to the pivot means.

16. The slip sheet removal apparatus of claim 15 wherein the pivot means comprises:

a stationary pivot plate supporting a vertically extending pivot pin; and a pivot pin mounting bracket secured to the lateral frame and rotatably connected to the pivot pin.

17. The slip sheet removal apparatus of claim 16 wherein the power means further comprises:

a frame structure;

a pivot roller conveyor wheel bearingly supporting the frame structure, the frame structure connected to the lateral frame so that the lateral frame is propelled upon rotation of the pivot roller conveyor wheel; and reversible motor means supported by the frame structure for selectively driving the pivot roller conveyor wheel.

* * * * *

UNITED STATES PATENT AND TRADEMARK OFFICE

CERTIFICATE OF CORRECTION

PATENT NO. : 4,889,463

DATED : December 26, 1989

INVENTOR(S) : Terry Frost et al.

It is certified that error appears in the above-identified patent and that said Letters Patent is hereby corrected as shown below:

Column 12, line 43 (claim 13, line 5), after "rollers;", start a new line for the element reading "a lateral frame supporting the roller frame for movement in a lateral direction;".

Signed and Sealed this

Twenty-third Day of July, 1991

*Attest:*

*Attesting Officer*

HARRY F. MANBECK, JR.

*Commissioner of Patents and Trademarks*